US005445590A

United States Patent [19]

Pazdernik

[11] Patent Number: 5,445,590

[45] Date of Patent: Aug. 29, 1995

[54] COLLAPSED, TUBULAR CARTON ERECTING APPARATUS

[75] Inventor: Irvan L. Pazdernik, Alexandria, Minn.

[73] Assignee: Douglas Machine Limited Liability Company, Alexandria, Minn.

[21] Appl. No.: 17,480

[22] Filed: Feb. 12, 1993

[51] Int. Cl.[6] ..... B31B 1/80

[52] U.S. Cl. ..... 493/317; 493/312; 53/566

[58] Field of Search ..... 493/183, 312, 313, 315, 493/316, 317, 141, 318; 53/566

[56] References Cited

U.S. PATENT DOCUMENTS

| | | | |
|---|---|---|---|
| 1,058,522 | 4/1913 | Auchu | 493/308 |
| 1,123,976 | 1/1915 | Auchu | 493/308 |
| 2,989,903 | 6/1961 | Wilcox . | |
| 3,323,283 | 6/1967 | Johnson, Jr. et al. | 53/566 |
| 4,061,081 | 12/1977 | Pinto et al. | 493/317 |
| 4,854,930 | 8/1989 | Miselli et al. | 493/317 |
| 4,917,229 | 4/1990 | Korkowski . | |
| 5,102,382 | 4/1992 | Center | 493/183 |
| 5,102,385 | 4/1992 | Calvert | 493/317 |
| 5,106,359 | 4/1992 | Lott | 493/151 |
| 5,207,630 | 5/1993 | Decker et al. | 493/317 |

*Primary Examiner*—Jack W. Lavinder
*Attorney, Agent, or Firm*—Peterson, Wicks, Nemer & Kamrath

[57] ABSTRACT

An apparatus (10) for erecting collapsed, tubular cartons (12) is disclosed including a device (32) for removing the top carton (12) of a vertical stack of cartons (12) in a hopper (26) and moving it in a horizontal orientation to an operative position. In the operative position, the second side panel (16) of the collapsed carton (12) underlies at least the first end panel (18) which is in a linear arrangement with the first side panel (14). Suction cups (76) carried by a frame (74) are secured to the second side panel (16) in an attachment position and moved by a parallelogram linkage to an open position located vertically below and coinciding with the first side panel (14). The bottom closure flap (23) is folded upwardly by a bending rod (82) as the frame (74) moves the carton (12) to its open condition. After an unload arm (84) is secured to the first end panel (18), tucking arms (102, 104, 106) are pivoted to tuck the remaining bottom closure flaps (22, 24, 25), with the last tucking arm (106) carrying a taping machine (114) to apply a tape piece (116) to the carton (12). The unload arm (84) is then pivoted about a first axis from the pickup position to a drop position and is simultaneously pivoted about a second axis from a first condition to a second condition to place the erected carton (12) in a chute (118) at an offset location and in a horizontal orientation. In the most preferred form, the unload arm (84) is pivoted about the second axis by a crank arm (98) secured to the unload arm (84) and a connector (100) having its opposite end secured to a stationary reference point when the unload arm (84) is pivoted about the first axis.

20 Claims, 5 Drawing Sheets

COLLAPSED, TUBULAR CARTON ERECTING APPARATUS

BACKGROUND

The present invention generally relates to apparatus for erecting cartons from a collapsed condition, particularly to apparatus for erecting cartons of the tubular type from a collapsed condition, and specifically to apparatus for erecting tubular cartons which have been previously utilized or which have not been previously utilized.

Many types of products are stored and transported in cartons which hold multiple products. Once reaching their final destination, the products are removed from the carton such as for their retail sale, and the carton is disposed of. Although previously such used cartons were simply disposed of as waste, with increasing ecological and environmental awareness, such used cartons are often recycled. However, to further enhance the reduction of waste, it has become desirable for the cartons to be reused multiple times (such as on the average of eight times) before they are recycled or otherwise disposed of. It can then be appreciated that with the product removed, it is then desired that the carton be stored and transported in a flat or collapsed condition for space reduction to the factory or similar location where the carton is again erected or set up for reuse by again filling the carton with product.

Various types of packaging machines exist for erecting or setting up cartons from a blank or collapsed condition such as but not limited to U.S. Pat. No. 4,917,663. However, most existing packaging machines were designed to handle cartons which have not been previously utilized and which have not been previously erected or set up. Cartons which have been previously used and then returned to their flat or collapsed condition for reuse are not as rigid as new cartons and are more difficult to automatically, mechanically handle. Thus, many prior packaging machines had difficulty handling and erecting used cartons. This difficulty is further complicated as cartons at various stages of their lives from being new to being reused their first or second time to being reused their last time and thus of varying degrees of rigidity and ease of handling are intermixed in their collapsed condition in the carton magazine or hopper of the packaging machines.

Additionally, it is desired that the reuse of cartons be as competitive as possible with utilizing only new cartons in packaging in addition to the ecological advantages gained by reuse. Towards that end, it is desired that handling of the reused carton be made as minimal and as easy as possible. It can then be appreciated that collapsed cartons are typically transported back to the factory for reuse on pallets. Thus, it is desired that the collapsed cartons be easily loaded into the erecting apparatus from pallets or the like. Many prior packaging machines include carton magazines which are relatively difficult to load individual cartons from a vertical stack on a pallet.

Thus a need exists for apparatus for erecting or setting up cartons from their flat or collapsed condition which is able to handle without difficulty intermixed cartons at various stages of their lives and which allows ease and minimization of handling reused cartons from vertical stacks.

SUMMARY

The present invention solves this need and other problems in the field of packaging machines for setting up or erecting cartons from their flat or collapsed condition by providing, in the most preferred form, cartons placed at an operative position with first and second panels in a linear arrangement and a third panel vertically below and underlying at least the second panel and with a frame in an attachment position abutting and removably secured to the third panel and movable in a horizontal orientation to an open position vertically below and horizontally offset from the attachment position located vertically below and coinciding with the first panel, with the first panel being held while the frame and the third panel secured thereto move from the attachment position to the open position.

In a further aspect of the present invention, the carton is removed from the top of a stack of collapsed cartons and moved in a horizontal orientation in a half-circle arc to the operative position. In the preferred form, the collapsed carton is removably secured to a placement shaft which is rotatably mounted between first and second, pivotable placement arms, with the placement shaft maintaining the same horizontal orientation during the pivoting of the first and second placement arms.

In another aspect of the present invention, an arm to which the carton is removably attached is pivoted about a first axis between a first position and a second position and simultaneously pivoted about a second axis between a first condition and a second condition, with the second axis being perpendicular to the first axis, to move the carton to an offset location and at a different orientation.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
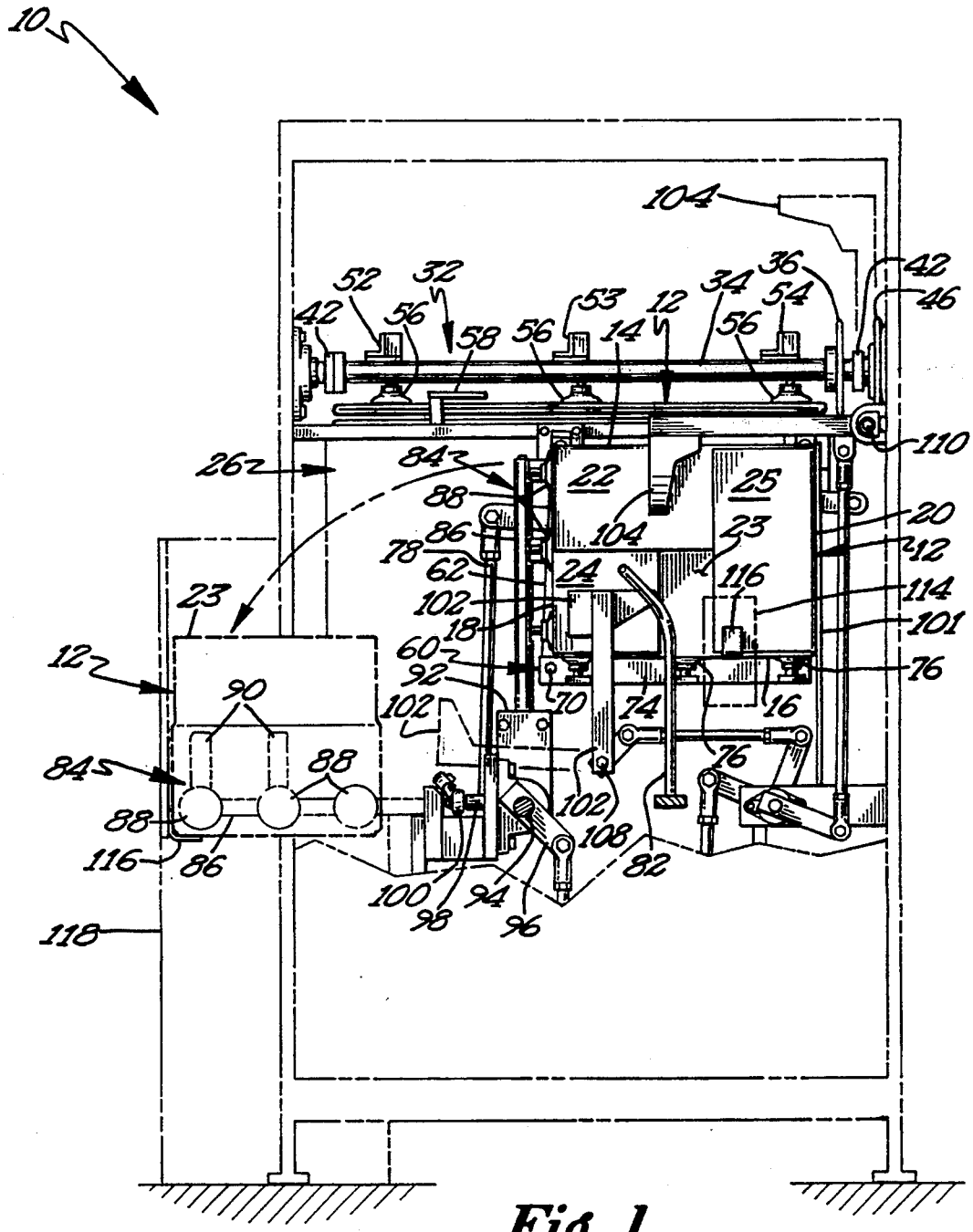
FIG. 1 shows a front, end view of an apparatus for erecting collapsed, tubular cartons according to the preferred teachings of the present invention, with portions shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood.

Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Apparatus for opening or erecting cartons according to the preferred teachings of the present invention is shown in the drawings and generally designated 10. Although apparatus 10 and the carton erecting method performed thereby may be utilized with cartons of various configurations, apparatus 10 is designed primarily for opening cartons 12 of the type illustrated in the drawings. Such cartons 12 generally comprise a plurality of body walls, such as side panels 14 and 16 and end panels 18 and 20 which are hingedly connected together along hinge connections into an annularly continuous tubular configuration in any suitable manner. Such body walls may have any suitable dimensional relationship, but in the embodiment illustrated, side panels 14 and 16 are of a width somewhat greater than the width of end panels 18 and 20. All of such walls have equal length, however. In the collapsed condition, panels 16 and 20 are vertically below, underlie, and are in contact with the inner surfaces of panels 14 and 18.

Hingedly connected to carton 12 at opposite ends thereof are carton closure means in the form of opposite cooperable pairs of closure flaps 22–25 which are intended to seal the top and bottom of carton 12. Corresponding flaps 22–25 at opposite ends of carton 12 generally are identical. Particularly, hingedly connected to the margin of each of side panels 14 and 16 are upper and lower major closure flaps 22 and 23, respectively. A pair of minor end closure side flaps 24 and 25 are hingedly connected to margins of opposite end panels 18 and 20, respectively. When carton 12 is collapsed, major flaps 22 and upper minor flaps 24 are vertically above, overlie and contact the inner faces of lower major flaps 23 and lower minor flaps 25.

Minor flaps 24 and 25 are of substantially less width than major flaps 22 and 23 so that the outer free edges of flaps 22 and 23 extend longitudinally of carton 12 beyond the outer free edges of minor flaps 24 and 25.

Figure 2:
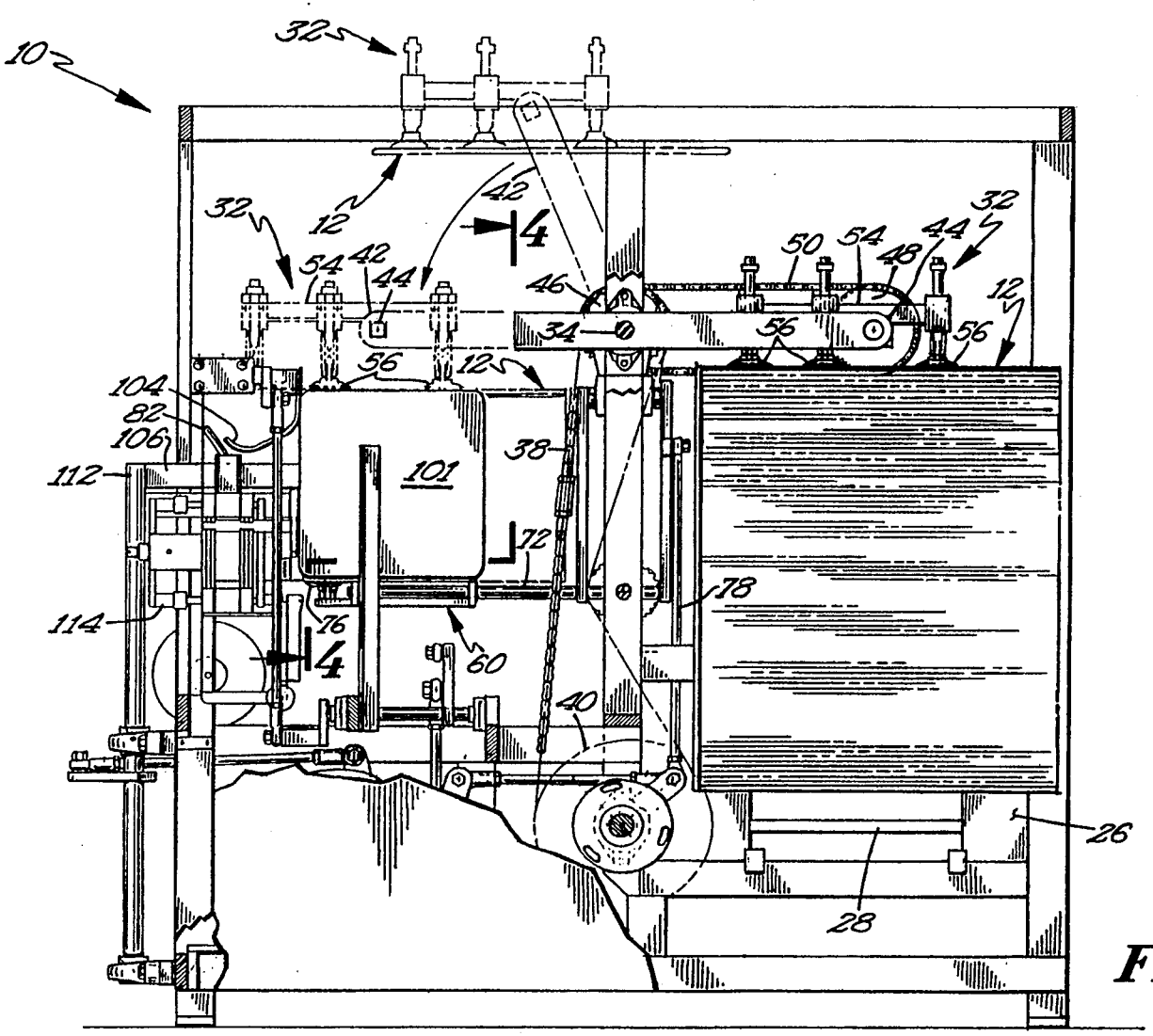
FIG. 2 shows a side elevational view of the apparatus of FIG. 1, with portions broken away for ease of illustration.
Figure 3:
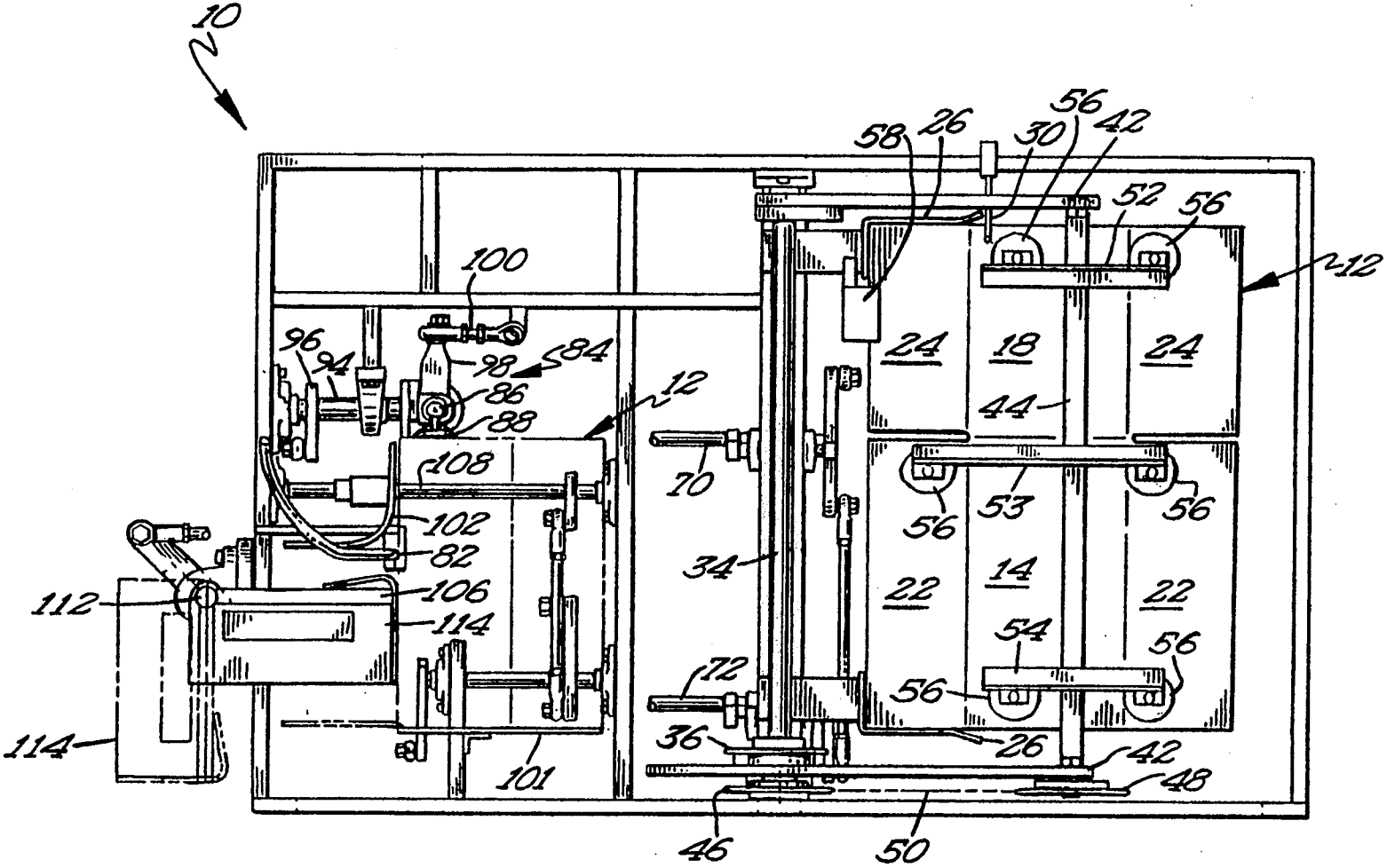
FIG. 3 shows a top plan view of the apparatus of FIG. 1, with portions broken away for ease of illustration.
Figure 4:
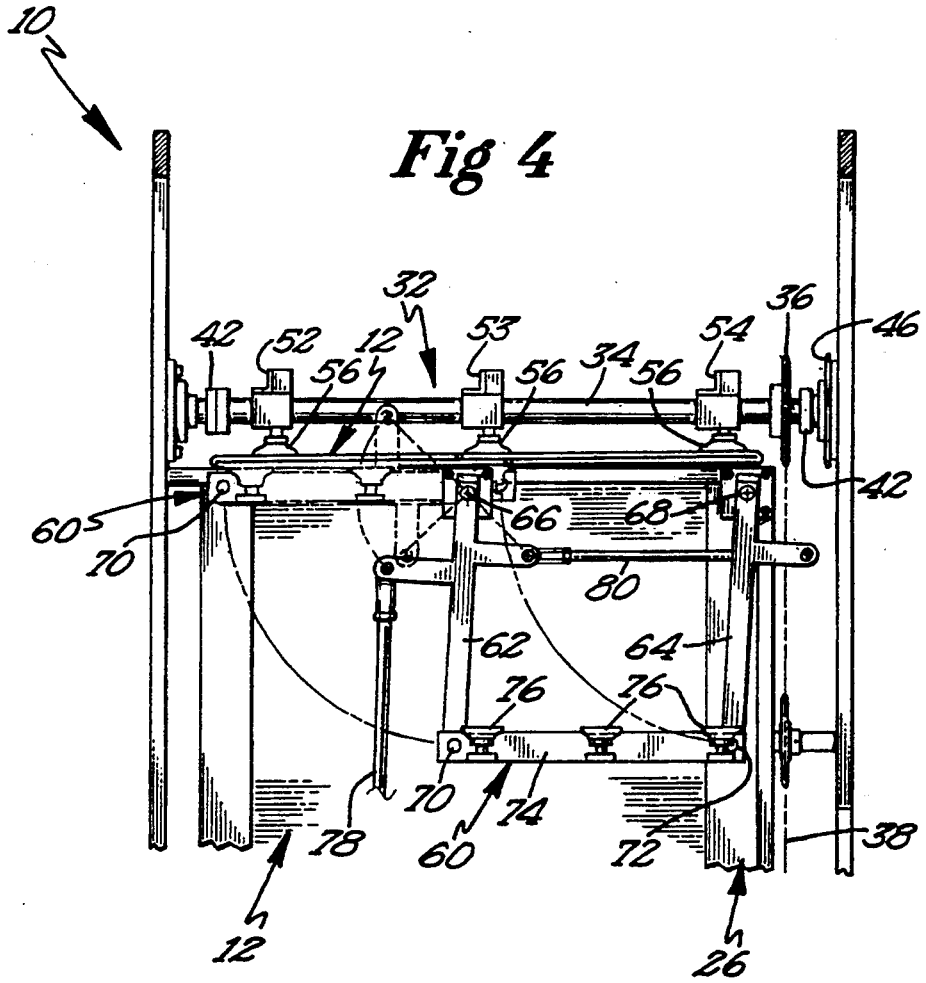
FIG. 4 shows a cross-sectional view of the apparatus of FIG. 1 according to section line 4—4 of FIG. 2.
Figure 7:
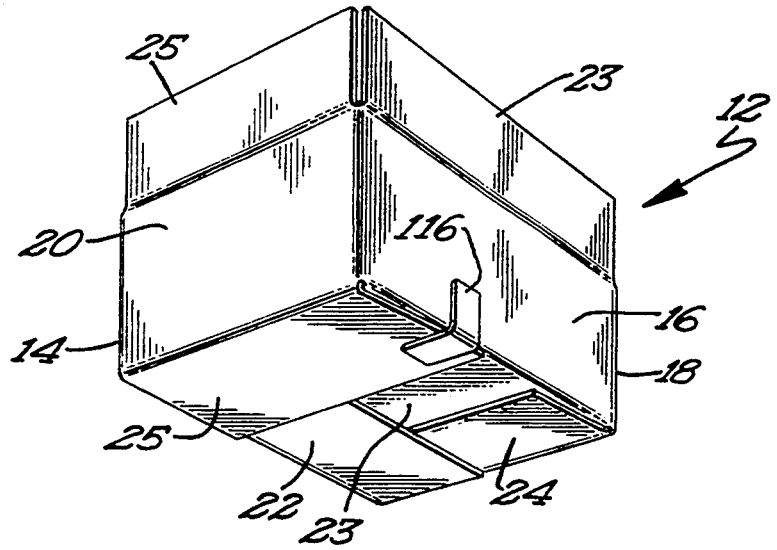
FIG. 7 shows a perspective view of a carton as erected by the apparatus of FIG. 1.
Figure 5:
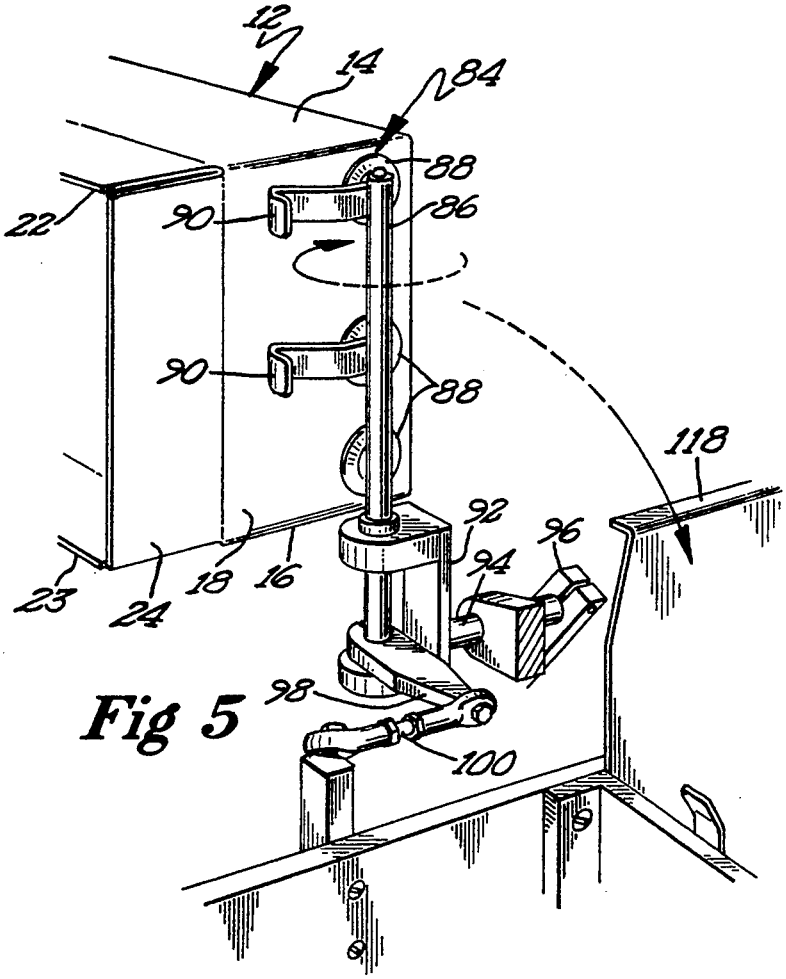
FIG. 5 shows a partial, perspective view of the unload arm of the apparatus of FIG. 1 in its pickup position.
Figure 6:
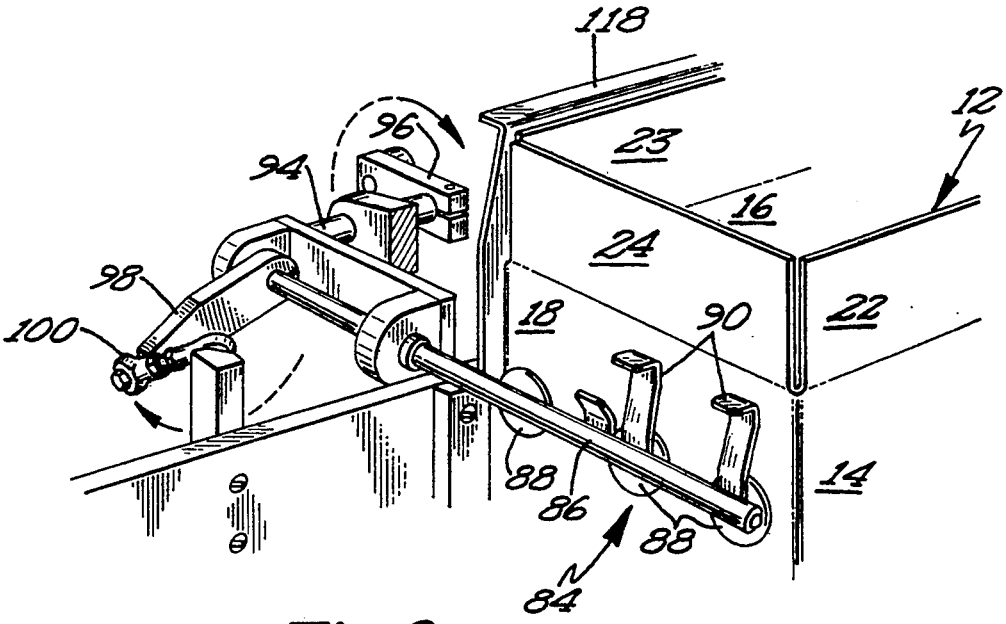
FIG. 6 shows a partial, perspective view of the unload arm of the apparatus of FIG. 1 in its drop position.

Apparatus 10 of the present invention is designed to transform cartons 12 from the collapsed tubular state shown in FIGS. 2, 3, and 4 to the open ended erected tubular state shown in FIGS. 1, 2, and 5–7 (and in phantom in FIG. 3). Apparatus 10 may take various forms but the illustrated embodiment includes a collapsed carton supply hopper 26 of any suitable design in which a supply of collapsed cartons 12 is positioned. In the preferred form, hopper 26 is vertically arranged with collapsed cartons 12 stacked upon a device 28 for raising or vertically lifting the stack of collapsed cartons 12. For example, device 28 in the preferred form is a scissor lift which is electrically controlled by a trigger 30 which rests upon and is supported by panel 18 in the preferred form. Thus, when the top carton 12 is removed from the top of the stack of cartons 12 supported upon lifting device 28 and from under trigger 30, device 28 is actuated to raise the stack of collapsed cartons 12 Until the next carton 12 (then the top) of the stack of cartons 12 engages with trigger 30 which stops further actuation of lifting device 28.

Apparatus 10 further includes a device 32 for removing carton 12 from the top of the stack of cartons 12 in hopper 26 and placing it at a horizontal position adjacent to hopper 26. In the most preferred form, a horizontal shaft 34 is rotatably mounted extending parallel to and spaced from the free edges of flaps 22–25 and spaced slightly above the top carton 12 in hopper 26. Shaft 34 is pivoted through a range of approximately 180° by any suitable means such as by a sprocket 36 driven by roller chain 38 extending around a sprocket 40 of a suitable drive. Device 32 further includes first and second arms 42 secured to and extending generally perpendicular from shaft 34, with the first and second arms 42 located on opposite sides of hopper 26. Rotation of shaft 34 causes the pivotal movement of arms 42 to move in a half-circle arc about shaft 34 between a horizontal, removal position located above and parallel to cartons 12 in hopper 26 and a horizontal, operative position generally horizontally offset from the removal position. A shaft 44 which in the preferred form is not circular in cross section and preferably square is pivotally mounted to and between the free ends of arms 42 spaced from and parallel to shaft 34. For keeping shaft 44 in the same rotational position relative to the support surface of apparatus 10 with the pivoting of arms 42, sprockets 46 and 48 are rotatably fixed to the frame and shaft 44 respectively and roller chain 50 extends therebetween. A plurality of support arms 52–54 are secured generally perpendicular to shaft 44 and in a spaced parallel relation. A plurality of suction cups 56 are secured to each of arms 52–54, with suction cups 56 of arm 52 attaching to panels 18 and 24, suction cups 56 of arm 53 attaching to panels 22 on the opposite sides of panel 14, and suction cups 56 of arm 54 attaching to panels 14 and 22 in the most preferred form.

In operation of device 32 of the most preferred form and assuming arms 42 are in their removal position with suction cups 56 abutting with and attached to the top carton 12 of hopper 26, shaft 34 is rotated by rotating sprocket 36 through roller chain 38. Due to its attachment through cups 54 and 56, arms 52, and shaft 44 to arms 42, the top carton 12 will be raised from hopper 26 when arms 42 are pivoted from their removal position towards their operative position. It should further be noted that the attachment of suction cups 56 holds panel 18 generally linearly with panel 14 to thus maintain carton 12 in its collapsed condition. Additionally, sprockets 46 and 48 and roller chain 50 in the most preferred form maintain arms 52–54 and carton 12 attached thereto in a horizontal condition generally parallel to the stacked cartons 12 in hopper 26 as arms 42 pivot from their removal position to their operative position. After suction cups 56 have released carton 12 as will be explained later, arms 42 can be pivoted from their operative position to their removal position with suction cups 56 abutting with and attached to the next carton 12 which will then be in the top position of hopper 26. It should be noted that, when carton 12 is removed from hopper 26 and from beneath trigger 30, device 28 is actuated to raise the stack of collapsed cartons 12 until the next carton 12 engages trigger 30 as set forth previously.

In the most preferred form, apparatus 10 further includes a flange 58 for abutting with the free outer edge of flap 24 for sealing the bottom of carton 12. In the most preferred form, flange 58 is spaced above the top carton 12 in hopper 26 and in the path of carton 12 after its removal from hopper 26 by device 32. Since flap 24 is not held by a suction cup 56 of device 32, flap 24 will deflect downward from panel 18 about its hinge connection therewith when the free outer edge engages flange 58. It can then be appreciated that this deflection will break the rigidity along the hinged connection of flap 24 and panel 18 of any new cartons 12 which have not been previously opened or erected. This breaking has been found to allow for ease of folding flap 24 relative to panel 18 for sealing the bottom of carton 12.

Apparatus 10 further includes a movable shelf 60 for support of and attachment to panel 16, with shelf 60 being movable from an attachment position to an open position. In the most preferred form, shelf 60 includes first and second arms 62 and 64 pivotally mounted about spaced, parallel axes 66 and 68 extending generally parallel to the hinge connections between panels 14, 16, 18, and 20. Rods 70 and 72 extend from the lower free ends of arms 62 and 64 vertically below and generally parallel to axes 66 and 68, with the spacing between axis 66 and rod 70 being equal to the spacing between axis 68 and rod 72. A frame 74 having a generally H-configuration has its opposite ends pivotally mounted to rods 70 and 72, with the spacing between rods 70 and 72 being equal to the spacing between axes 66 and 68. Suction cups 76 are attached to frame 74 in a single linear arrangement extending generally perpendicular between rods 70 and 72. It can then be appreciated that a parallelogram mounting is provided for keeping frame 74 vertically below, horizontal and parallel to the plane of axes 66 and 68. Frame 74 and suction cups 76 have a size corresponding to panel 16, with suction cups 76 located on panel 16 adjacent and parallel to the hinge connection with flap 23. Frame 74 and suction cups 76 are movable between the attachment position and the open position in the most preferred form by a rod 78 pivotally connected to arm 62 and reciprocal by any suitable means such as that illustrated. A connection rod 80 extends between arms 62 and 64 to insure simultaneous, parallelogram movement of arms 62 and 64. In its attachment position, frame 74 and suction cups 76 are vertically below and abut with panel 16 of carton 12 in its collapsed condition abutting with panel 18. In its attachment position, suction cups 76 can be attached to panel 16. After release of suction cups 56 of arm 52, frame 74 and suction cups 76 can be moved to its open position located vertically below, parallel to and coinciding with panel 14 and spaced therefrom generally equal to the width of panels 18 and 20. Due to the attachment of suction cups 76 to panel 16, movement of frame 74 and suction cups 76 to its open position causes carton 12 to also open with panels 18 and 20 pivoting about their hinge connections to panels 14 and 16 in a parallelogram movement corresponding to the parallelogram movement of frame 74 and suction cups 76 relative to shaft 44, arms 53 and 54 and suction cups 56 secured thereto. As panel 14 is attached to suction cups 56 of arms 53 and 54 and panel 16 is attached to suction cups 76, a horizontal, parallel relationship is maintained between panels 14 and 16 during movement of frame 74 from the attachment position to the open position.

It should then be appreciated that panel 14 is firmly supported by suction cups 56 to maintain a planar configuration. Likewise, panel 16 is supported by and attached to frame 74 by suction cups 76 to maintain a planar configuration (with suction cups 76 located adjacent to and parallel the hinge connection with flap 23). Additionally, panels 18 and 20 maintain their planar configuration due to their parallelogram movement relative to panels 14 and 16. Thus, apparatus 10 is able to open cartons 12 from a collapsed condition of various degrees of rigidity from being not previously opened to being opened and collapsed a multiple number of times, and with cartons 12 of intermixed degrees of rigidity without handling difficulties.

In the most preferred form, apparatus 10 includes provisions for mechanically folding flaps 22–25 to seal the bottom of carton 12. In the preferred form, a stationary bending bar 82 engages with flap 23 and moves it from a position extending generally linearly with panel 16 to a position extending generally perpendicular with panel 16 and towards panel 14 as panel 16 is moved from the collapsed condition to the open position. It should be noted that due to the position of suction cups 76 adjacent to the hinge connection between panel 16 and flap 23, flap 23 will tend to fold along the hinge connection and will not tend to fold at other, undesired locations even if carton 12 has been reused multiple times or has not been previously used.

Apparatus 10 in the most preferred form, further generally includes an unload arm 84. Arm 84 generally includes a rod 86 including multiple suction cups 88 mounted thereto for connection to panel 18 adjacent to the hinge connection between panel 18 and flap 24. Support flanges 90 extend from rod 86 and abut with panel 18 spaced from its hinge connection with flap 24 and on the opposite side of rod 86. Rod 86 is pivotally mounted in the upstanding legs of a U-shaped support 92. Support 92 is pivotable 90° between a vertical, pickup position and a horizontal, drop position about an axis extending perpendicular to rod 86. In the preferred form, a shaft 94 extending along the pivot axis of support 92 is secured to the central portion of support 92 from which the legs of support 92 upstand and parallel to the direction of the legs of support 92. Shaft 94 can be rotated by any suitable means such as by a crank arm 96 as shown. Rod 86 is simultaneously rotated 90° in support 92 between first and second conditions as support 92 is pivoted between its pickup and drop positions. In the most preferred form, a crank arm 98 extends generally perpendicular from rod 86 intermediate the legs of U-shaped support 92. A turnbuckle 100 extends from the free end of arm 98 and a stationary portion or reference point of the frame of apparatus 10. As support 92 is pivoted between the pickup position and the drop position, arm 98 and turnbuckle 100 rotate rod 86 between a first condition with suction cups 88 in a plane perpendicular to the plane of the central portion of support 92 when rod 86 and support 92 are in the pickup position and a second condition with suction cups 88 in a plane parallel to the plane of the central portion of support 92 when rod 86 and support 92 are in the drop position. In the most preferred form, rod 86 and support 92 are in the drop position as frame 74 moves from the attachment position towards the open position and moves to the pickup position in a non-interfering manner with frame 74. In the pickup position, flanges 90 abut with panel 18 and suction cups 88 attach to panel 18. It can be appreciated that once carton 12 is attached to suction cups 88 and to suction cups 76, carton 12 is held in an open condition as panels 16 and 18 are held perpendicularly to each other. In the most preferred form, a stationary abutment 101 is positioned to abut with panel 20 to assist in holding carton 12 in the open condition. Anytime thereafter, suction cups 56 of device 32 can be released depending upon the additional support for panel 14 desired, with device 32 moving from its operative position to its removal position after release of suction cups 56.

Apparatus 10 further includes tucking arms 102, 104, and 106 pivotally mounted about axes 108, 110, and 112, respectively, and each are pivotable between a non-interfering position and a tucking position. Specifically, arm 102 pivots about axis 108 extending perpendicular to the hinge connection between panel 18 and flap 24 and generally parallel to panel 16 and folds flap 24 relative to panel 18 from a position extending generally linearly from panel 18 to a position extending generally perpendicular to panel 18 towards panel 20 as it moves from its non-interfering position to its tucking position after securement of suction cups 88 to panel 18. Similarly, arm 104 pivots about axis 110 extending generally perpendicular to the hinge connection between panel 14 and flap 22 and generally parallel to panel 14 and axis 108 and folds flap 22 relative to panel 14 from a position extending generally linearly from panel 14 to a position extending generally perpendicular to panel 14 towards panel 16 as it moves from its non-interfering position to its tucking position, with flap 22 moving after flap 24. Likewise, arm 106 pivots about axis 112 extending generally perpendicular to the hinge connection between panel 20 and flap 25 parallel to panel 20, and perpendicular to axes 108 and 110 and folds flap 25 relative to panel 20 from a position extending generally linearly from panel 20 to a position extending generally perpendicular to panel 20 towards panel 18 as it moves from its non-interfering position to its tucking position, with flap 25 moving after flap 22. In the most preferred form, arm 106 carries a taping machine 114 such as of the type manufactured by Prototype Equipment Corporation for attaching a tape piece 116 extending between and adhered to flap 25 and panel 16. In the preferred form of the present invention, additional taping of the bottom of carton 12 occurs in additional operations after apparatus 10. It can be appreciated that arms 102, 104, and 106 can be pivoted from their tucking positions to their non-interfering positions after placement of later flaps and/or tape piece 116. Arms 102, 104, and 106 can be pivoted about axes 108, 110, and 112, respectively, by any suitable means such as by connecting rods having their opposite ends connected to crank arms attached to rotatable shafts, with the crank arms for arms 102 and 104 being connected to the same rotatable shaft for simultaneous movement therewith in the most preferred form.

After tape piece 116 has been applied, after suction cups 76 have been released, and after device 32 has moved away from its operative position, unload arm 84 can move from its pickup position to its drop position. Particularly, moving from its pickup position, arm 84 lifts carton 12 having panel 16 resting upon frame 74 and extending generally horizontally and the sealed bottom of carton 12 extending generally vertically. In its drop position, arm 84 places carton 12 in a chute 118 diagonally offset from frame 74 and with panels 14, 16, 18, and 20 extending generally vertically and the sealed bottom of carton 12 extending generally horizontally. When carton 12 is located .in chute 118, suction cups 88 can be released allowing carton 12 to pass into chute 118 for further processing as desired. It should be noted that support flanges 90 support carton 12 and prevent pivotal-type movement of carton 12 around rod 86 as rod 86 is pivoted about shaft 94 and rotated in support 92.

After carton 12 is moved by arm 84 in a non-interfering relation with frame 74, frame 74 and suction cups 76 can move from their open position to their attachment position for securement to the next collapsed carton 12 to be erected.

Now that the construction and operation of apparatus 10 according to the preferred teachings of the present invention have been explained, further subtle features and advantages of apparatus 10 can be set forth and appreciated. Particularly, to allow ease and reduction of handling, it is desired that collapsed cartons 12 be presented to apparatus 10 in a vertically stacked condition such as in hopper 26 of the most preferred form with removal of cartons 12 occurring from the top of the stack of collapsed cartons 12. Device 32 is then particularly advantageous in being able to present cartons 12 to be erected from the top of a stack of collapsed cartons 12 and in doing so in a mechanically simple manner. Particularly, utilizing a motion and mechanism similar to that shown and described in U.S. Pat. No. 4,917,229, device 32 is able to remove and place carton 12 in a collapsed condition in a generally vertical manner while moving carton 12 to a horizontally offset location from hopper 26. Specifically, although horizontal movement occurs during movement along the half-circle arc, movement of cartons 12 at the beginning and ending of the half-circle arc is generally vertical with the horizontal movement component being minimal at those points of the arc. Additionally, cartons 12 are held in a horizontal orientation to minimize the overall height required for apparatus 10. Device 32 is then able to utilize a motion and mechanism similar to that shown and described in U.S. Pat. No. 4,917,229 for a different purpose as a solution to the particular manner of carton presentation desired in the environment of carton removal and placement.

Likewise, although it has been known to erect a collapsed tubular carton positioned between flights of a lower conveyor by attaching to and vertically raising the top panel utilizing a parallelogram movement assembly for positioning between flights of an upper conveyor for additional operations while held by the flights of the upper and lower conveyors, apparatus 10 of the preferred form is able to erect carton 12 (and in the most preferred form to seal the bottom) utilizing a similar but inverted movement. This is particularly advantageous as apparatus 10 utilizes gravitational forces acting upon panels 16, 18, and 20 and flaps 22, 24 and 25 connected thereto to erect cartons 12 such that the amount of energy and attachment suction required is reduced. In fact, for cartons 12 which have been reused many times, frame 74 and suction cups 76 of apparatus 10 in fact often slow and control the fall of panel 16 after release of suction to cups 56 of arm 52 due to the lack of rigidity of such reused cartons 12 as compared to previously unused cartons 12. Additionally, apparatus 10 does not require the use of flight conveyors, which substantially reduces the size requirement of apparatus 10. Additionally, apparatus 10 further allows sealing the bottom of cartons 12 while still being held by shelf 60 (and by device 32 and/or arm 84) such that later packaging stations are not needed to seal the bottom to further reduce the size and complexity of apparatus 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for erecting a collapsed carton, with the carton including first, second, and third panels connected together about hinge connections, with the second panel located intermediate the first and third panels, comprising, in combination: a frame for supporting the third panel and including means for removable securement to the third panel; means for moving the frame from an attachment position and an open position, with the frame in the attachment position being vertically above and horizontally offset from the open position, with the frame being horizontally orientated in the attachment and open positions and intermediate the attachment and open positions; and means for placing the carton at an operative position with the first and second panels in a linear arrangement and the third panel located vertically below and underlying at least the second panel and with the frame in the attachment position abutting the third panel, with the placing means holding the first panel at an operative position above and generally parallel to the frame while the frame moves from the attachment position to the open position.

2. The device of claim 1 wherein the placing means moves the carton vertically downward into the operative position.

3. The device of claim 2 further comprising, in combination: a hopper for holding a vertical stack of collapsed cartons at a location horizontally offset from the operative and open positions; and wherein the placing means removes the carton from the top of the stack of cartons in the hopper and places the carton at the operative position.

4. The device of claim 3 wherein the placing means comprises, in combination: means for moving the carton in a half-circle arc, with the first, second, and third panels of the carton being horizontally orientated during movement by the placing means.

5. The device of claim 4 wherein the moving means comprises, in combination: first and second placement arms pivotally mounted on opposite sides of the carton and about a horizontal axis located intermediate the hopper and the open position; a placement shaft rotatably mounted to the free ends of the first and second placement arms; means for removably securing the carton to the placement shaft; and means for maintaining the placement shaft in the same horizontal orientation during pivoting of the first and second placement arms.

6. The device of claim 1 wherein the carton includes bottom closure flaps connected to the panels about hinge connections; and wherein the device further comprises, in combination: a plurality of tucking arms corresponding to the closure flaps, with the tucking arms each being movable between a non-interfering position and a tucking position, with the tucking arms moving from their non-interfering positions to their tucking positions while the third panel is removably secured to the frame in the open position.

7. The device of claim 6 further comprising, in combination: an attachment arm movable between a pickup position and a drop position, with the attachment arm including means for attaching to the second panel, with the attachment arm being attached to the second panel while the tucking arms move from their non-interfering positions to their tucking positions.

8. The device of claim 7 wherein the attachment arm removes the carton from the frame in the open position after release of the third panel removable securement means when the attachment arm is moved from its pickup position to its drop position.

9. The device of claim 8 further comprising, in combination: first means for pivoting, the attachment arm about a first axis between the pickup position and the drop position; and second means for simultaneously pivoting the attachment arm about a second axis between a first condition and a second condition, with the second axis being perpendicular to the first axis.

10. The device of claim 9 wherein the second means comprises means attached to a stationary reference point and the attachment arm for pivoting the attachments arm between the first and second conditions when the attachment arm pivots between the pickup and drop positions.

11. The device of claim 10 wherein the second means comprises a crank arm secured to the attachment arm and extending generally perpendicular to the attachment arm; and a connector extending between the stationary reference point and the crank arm.

12. The device of claim 1 further comprising, in combination: an attachment arm including means for removably attaching the second panel of the carton to the attachment arm; first means for pivoting the attachment arm about a first axis between a first position and a second position; and second means for simultaneously pivoting the attachment arm about a second axis between a first condition and a second condition, with the second axis being perpendicular to the first axis.

13. The device of claim 12 wherein the second means comprises means attached to a stationary reference point and the attachment arm for pivoting the attachment arm between the first and second conditions when the attachment arm pivots between the first and second positions.

14. The device of claim 13 wherein the second means comprises a crank arm secured to the attachment arm and extending generally perpendicular to the attachment arm; and a connector extending between the stationary reference point and the crank arm.

15. Device for erecting a collapsed carton, with the carton including first, second, and third panels connected together about hinge connections, with the second panel located intermediate the first and third panels, comprising, in combination: means for removable securement to the third panel; means for moving the third panel removable securement means from an attachment position and an open position, with the third panel removable securement means in the attachment position being vertically above and horizontally offset from the open position, with the third panel removable securement means being horizontally orientated in the attachment and open positions and intermediate the attachment and open positions; and means for placing the carton at an operative position with the first and second panels in a linear arrangement and the third panel located vertically below and underlying at least the second panel and with the third panel removable securement means in the attachment position abutting the third panel, with the placing means holding the first panel at an operative position above and generally parallel to the third panel removable securement means while the third panel removable securement means moves from the attachment position to the open position wherein the placing means moves the carton vertically downward into the operative position.

16. The device of claim 15 further comprising, in combination: a hopper for holding a vertical stack of collapsed cartons at a location horizontally offset from the operative and open positions; and wherein the placing means removes the carton from the top of the stack of cartons in the hopper and places the carton at the operative position.

17. The device of claim 16 wherein the placing means comprises, in combination: means for moving the carton in a half-circle arc, with the first, second, and third panels of the carton being horizontally orientated during movement by the placing means.

18. The device of claim 17 wherein the moving means comprises, in combination: first and second placement arms pivotally mounted on opposite sides of the carton and about a horizontal axis located intermediate the hopper and the open position; a placement shaft rotatably mounted to the free ends of the first and second placement arms; means for removably securing the carton to the placement shaft; and means for maintaining the placement shaft in the same horizontal orientation during pivoting of the first and second placement arms.

19. The device of claim 15 wherein the placing means comprises, in combination: means for moving the carton in a half-circle arc, with the first, second, and third panels of the carton being horizontally orientated during movement by the placing means.

20. The device of claim 19 wherein the moving means comprises, in combination: first and second placement arms pivotally mounted on opposite sides of the carton and about a horizontal axis located intermediate the hopper and the open position; a placement shaft rotatably mounted to the free ends of the first and second placement arms; means for removably securing the carton to the placement shaft; and means for maintaining the placement shaft in the same horizontal orientation during pivoting of the first and second placement arms.

* * * * *